US011633033B2

(12) United States Patent
Moretti

(10) Patent No.: US 11,633,033 B2
(45) Date of Patent: Apr. 25, 2023

(54) LIP STICK MACHINE FOR LIPS

(71) Applicant: LUMSON S.p.A., Capergnanica (IT)

(72) Inventor: Matteo Moretti, Crema (IT)

(73) Assignee: LUMSON S.p.A., Capergnanica (IT)

( * ) Notice: Subject to any disclaimer, the term of this patent is extended or adjusted under 35 U.S.C. 154(b) by 141 days.

(21) Appl. No.: 17/197,905

(22) Filed: Mar. 10, 2021

(65) Prior Publication Data

US 2021/0282535 A1 Sep. 16, 2021

(30) Foreign Application Priority Data

Mar. 11, 2020 (IT) ..... 102020000005209

(51) Int. Cl.
*A45D 40/12* (2006.01)
*A45D 40/06* (2006.01)
*A45D 40/00* (2006.01)

(52) U.S. Cl.
CPC ..... *A45D 40/12* (2013.01); *A45D 40/06* (2013.01); *A45D 2040/0025* (2013.01)

(58) Field of Classification Search
CPC ..... A45D 40/06; A45D 40/065; A45D 40/12
See application file for complete search history.

(56) References Cited

U.S. PATENT DOCUMENTS 6,513,536 B1 * 2/2003 Demellier ..... A45D 40/12 132/318
2019/0082809 A1 3/2019 Benigni et al.

FOREIGN PATENT DOCUMENTS

| | | | |
|---|---|---|---|
| BR | PI0903987 | A2 | 6/2011 |
| ES | 1027752 | U | 10/1994 |
| FR | 1489494 | A | 7/1967 |
| JP | S5320664 | A | 2/1978 |
| JP | 5240835 | B2 | 7/2013 |

* cited by examiner

*Primary Examiner* — Jennifer C Chiang
(74) *Attorney, Agent, or Firm* — Dickinson Wright PLLC; Andrew D. Dorisio

(57) ABSTRACT

A lip stick machine includes a first tubular body on which a second tubular body is rotatably fitted, the first tubular body having at least one first guide and the second tubular body having at least one second guide, a cursor equipped with at least one first pin so that a mutual rotation of the first tubular body causes an axial translation of the cursor, a closure equipped with a tubular projection for coupling with a first free edge of the first tubular body when the closure is fitted on the machine; the second tubular body has a first annular groove open on a second free edge of the second tubular body, the first tubular body having a flange at the first free edge positioned inside the first annular groove so as to load a lateral surface of the annular groove when the closure is fitted on the machine.

12 Claims, 3 Drawing Sheets

LIP STICK MACHINE FOR LIPS

This application claims priority to Italian Patent Application for Invention No. 102020000005209 filed on Mar. 11, 2020, the disclosure of which is incorporated herein by reference.

FIELD OF THE INVENTION

The present invention relates to a lip stick machine for lips.

In particular, it refers to a machine for lipstick, lip gloss, cocoa butter etc.

BACKGROUND

With the arrival of e-commerce, the packing and packaging of various products, also of cosmetic type, has become increasingly important.

In the specific case of lipstick or sticks for lips that are marketed in special machines that constitute the packaging, it has been found that carriage to the end user constitutes an important source of harm.

In fact, although great care has been taken over the packing of the machine, the packing is always subject to shocks or sudden acceleration or deceleration during the movement of the packing itself.

It has been found that conventional machines, like for example the machine disclosed in U.S. Pat. No. 6,035,866, in the presence of major shocks, does not protect the stick appropriately.

When subjected to transport tests (for example the one known as the Amazon test), a movement of the cursor occurs that pushes the lipstick against the closure, thus damaging the tip thereof.

This is unacceptable, especially when the dispatched products are costly and of high quality, and thus directed at a very demanding clientele.

SUMMARY OF THE INVENTION

The object of this invention is to provide a lip stick machine for lips that overcomes the drawbacks of the prior art.

A further object of the present invention is to provide a machine that is able to withstand major shocks, protecting appropriately the lip stick without the lip stick getting damaged.

This object and other objects are achieved by a lip stick machine for lips devised according to the technical teachings of the annexed claims.

SHORT DESCRIPTION OF THE FIGURES

Further features and advantages of the innovation will become clear from the description of a preferred but non-exhaustive form of the device, illustrated by way of non-limiting example in the enclosed drawings, in which.

DETAILED DESCRIPTION OF THE INVENTION

Figure 1:
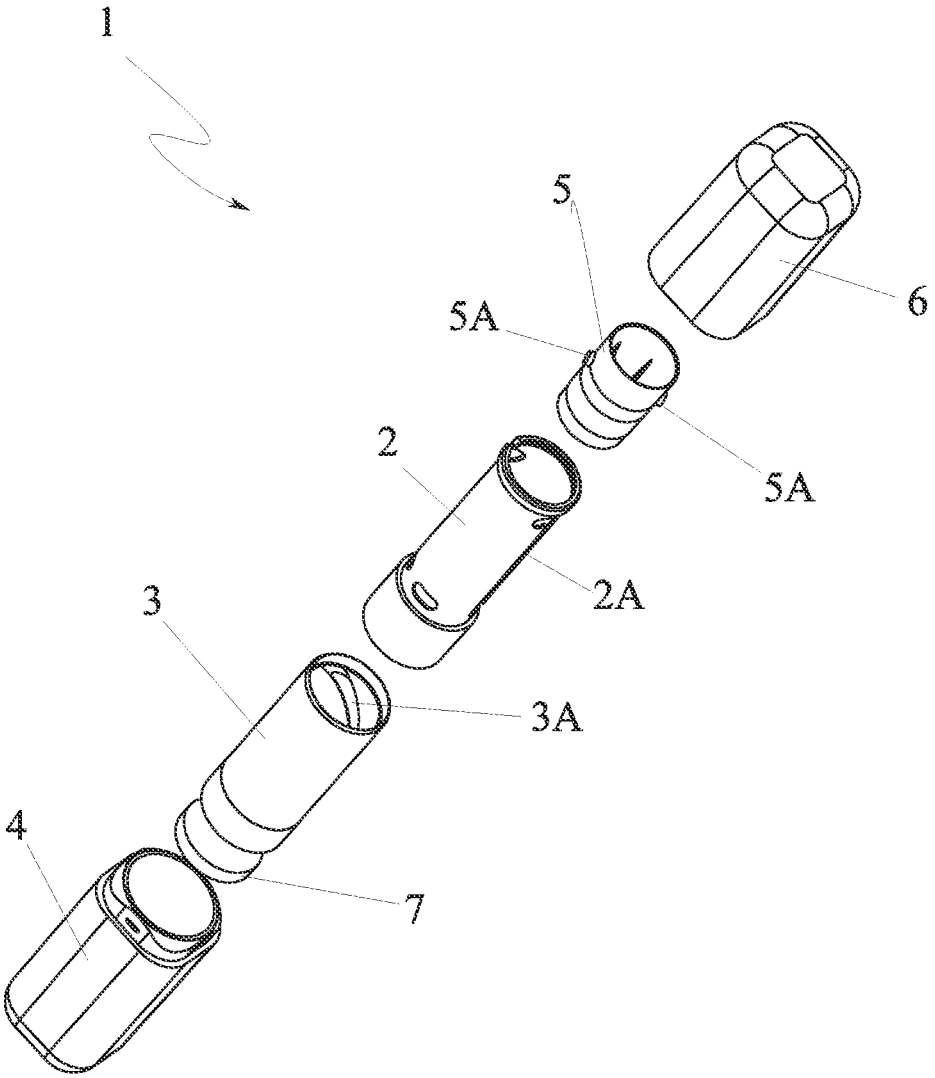
FIG. 1 is an exploded perspective view of the various parts of the machine of the present invention.

With reference to the cited figures, a lip stick machine for lips is shown that is indicated overall by reference number 1.

The stick for lips is preferably a lipstick, cocoa butter, lip balm etc.

The machine 1 (or container) comprises a first tubular body 2 on which a second tubular body 3 is rotatably fitted.

The first tubular body 2 has at least one first guide 2A (but preferably two identical and symmetrical guides 2A) and the second tubular body has at least one second guide 3A (but preferably two identical and symmetrical guides 2A).

The machine further comprises a cursor 5 equipped with at least one first pin 5A (but also here preferably two) housed both in said first 2A and in said second guide 3A.

In this manner, mutual rotation of the first tubular body 2 with respect to the second tubular body 3 causes an axial translation of the cursor 5, in a completely conventional and known manner.

The first guide 2A can be substantially rectilinear and the second guide 3A can be substantially helical (see FIG. 3) or vice versa.

Figure 2:
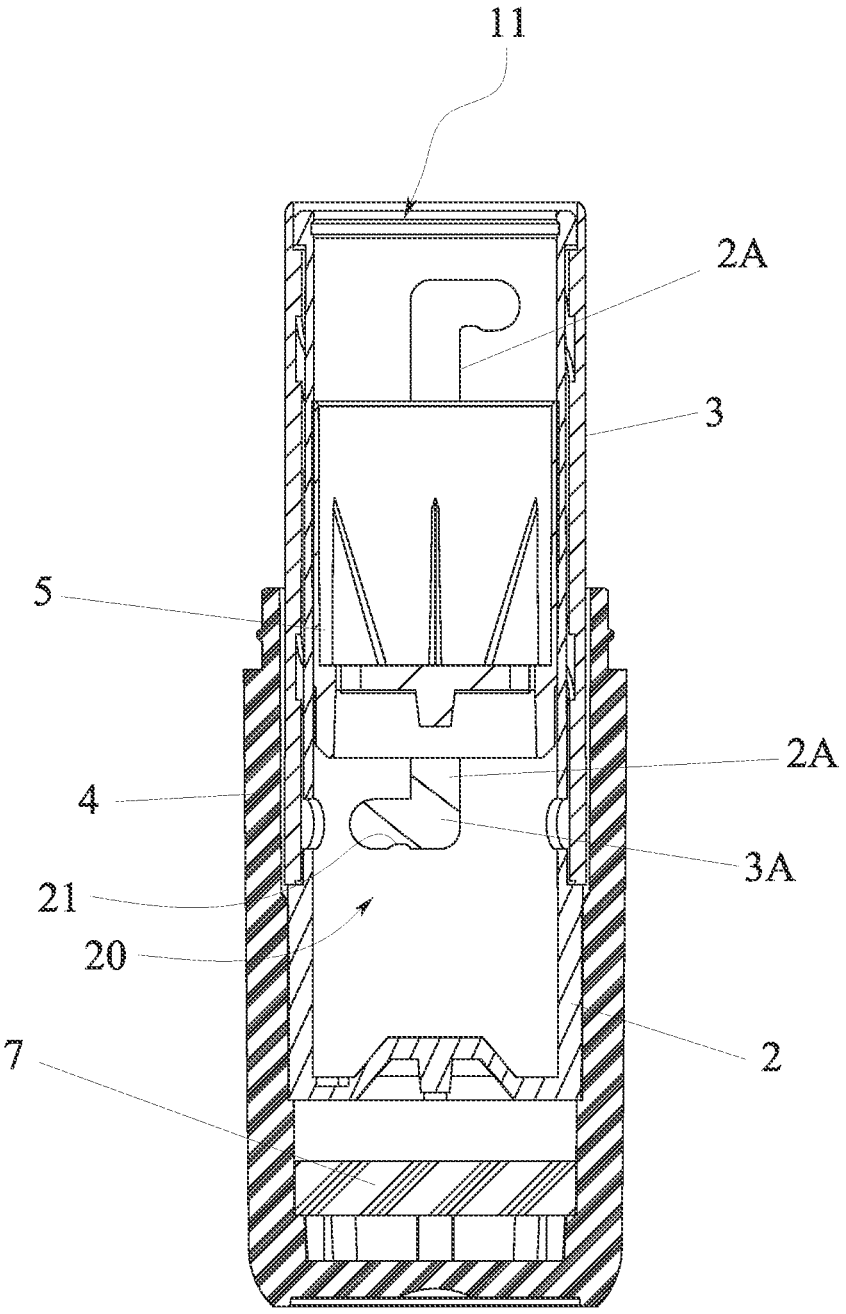
FIG. 2 is a section view, without closure, of the machine of FIG. 1 when assembled.

As can be seen in FIG. 2, the substantially rectilinear guide 2A can comprise an L-shaped end portion 20, in which a tooth 21 is obtained that stabilizes said pin 5A when in an end stroke position (for example when the cursor is completely retracted).

Also, the opposite end of the guide 2A can have the same conformation, to stabilize the cursor when it is positioned on the upper end stroke position (i.e. completely extracted stick).

The machine further comprises a closure 6 equipped with a tubular projection 9, which is possibly discontinuous, configured to couple with a first free edge 11 of the first tubular body 2 when the closure 6 is fitted on the machine 1.

The tubular projection 9 can be obtained as one piece with the closure 6.

Figure 4:
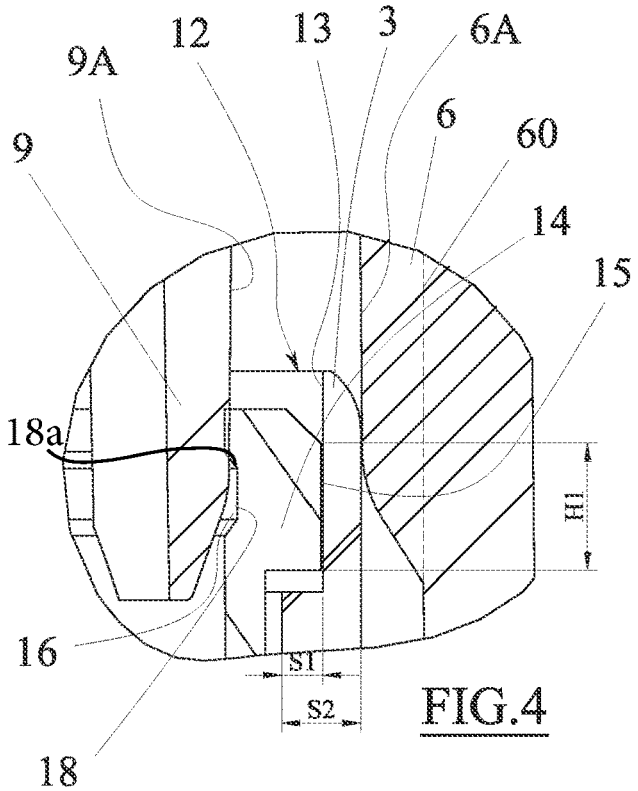
FIG. 4 is an enlargement of the part enclosed in the circle of FIG. 3.
Figure 5:
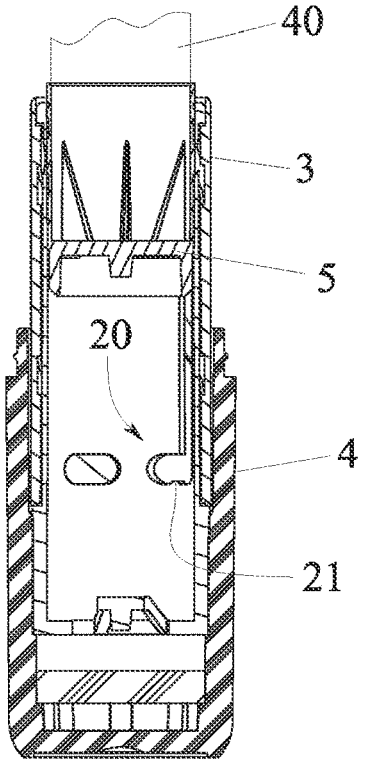
FIG. 5 is a section of the machine with a completely raised cursor, with a stick for lips associated therewith.

According to the invention, the second tubular body 3 has a first annular groove 13 open on a second free edge 12 of the second tubular body 3 (see FIG. 4).

The first groove 13 can have an L-shaped section.

Advantageously, the ratio between the total thickness S2 of the wall of the second body 3 and the depth S1 of the groove can be comprised between 2.5 and 1.5, preferably about 2.

For example, the groove can have a depth S1 comprised between 0.3 and 0.8 mm, preferably 0.5 mm, whereas the total thickness S2 of the wall of the second body 3 can be comprised between 0.4 mm and 1.2 mm, preferably 0.9 mm.

In fact, the groove is a break that causes an inner diameter of the cylindrical opening of the second tubular body 3 to be greater than that of the rest of the tubular body.

The first tubular body 2 on the other hand has a flange 14 protruding at the first free edge 11; the flange 14 is positioned inside said first annular groove 13 so as to load a lateral surface 15 of the annular groove 13 when the closure 6 is fitted on the machine and the first free edge 11 is coupled with the tubular projection 9 of the closure.

In this manner, the tubular projection 9 can press the flange 14 against the inner surface 15 of the groove, creating great friction between the first body 2 and the second body 3, which cannot rotate even in the presence of great shocks.

In the configuration shown in FIG. 4 it is noticed that the second body 3 can press against a surface with a reduced diameter 6A of the closure 6. The surface 6A can be continuous or discontinuous, for example achieved by ribbing. Further, the surface 6A and/or the tubular projection can have a tongue to promote the insertion of the closure 6 in position.

In this solution, the end of the first body 2 and of the second body 3 are sandwiched between the tubular projection 8 and the surface with a reduced diameter 6A. This contributes to contrasting even further the rotation of the two bodies when the closure 6 is in position.

This means that the surface with a reduced diameter 6A is not essential, but preferred, for operation of the invention. Thus, the closure 6 can also have a simplified surface like that shown (for simplicity only in the right part of FIGS. 3 and 4) with dashed line 60, and thus devoid of a surface of reduced diameter that cooperates with the free end of the second body 3.

In all cases, the impossibility of rotation between the first and the second body in fact stabilizes the cursor 5 that remains in a lowered position (lower end stroke position), thus preventing a possible shock between the tip of the stick for lips and the closure 6.

Figure 3:
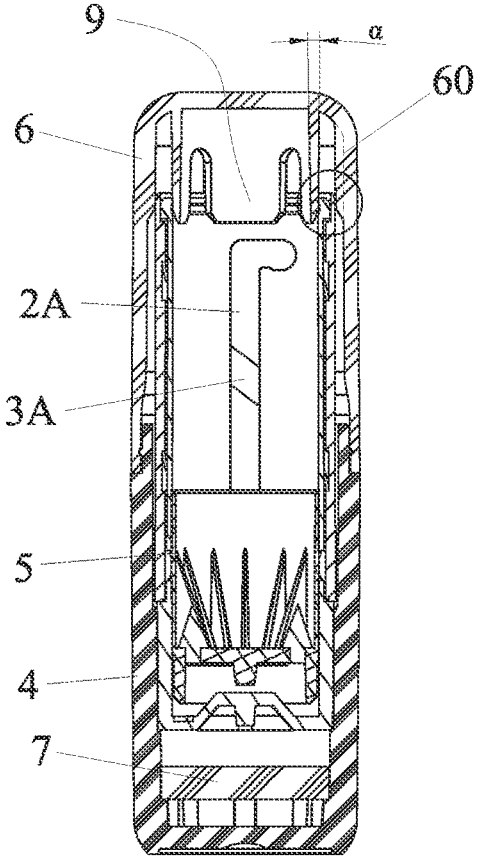
FIG. 3 is a section view of the machine of FIG. 1, provided with closure and with the cursor lowered.

The presence of the flange 14 further improves the dimensional stability of the first body 2 precisely in the zone in which it is loaded peripherally from the tubular projection 9, thus preventing excessive or discontinuous deformation thereof that would compromise the visual appeal of the first and of the second body, especially when the tubular projection 9 is discontinuous (as shown in FIG. 3).

Advantageously, a surface 16 of the first body 2 facing the tubular projection 9 has a second groove 18 at said flange 14 and/or in which the second groove 18 has a C-shaped section 18*a*.

It has been found that this configuration increases the pressure detected at the contact zone 15 between the outer perimeter of the flange 14 and the surface of the second body 3 that defines the groove 13.

The contact zone 15 between the groove and said flange has a height H1 advantageously comprised between 1.5 and 6 mm, preferably 2.25 mm.

The invention is particularly useful when the tubular projection 9 has a conical perimeter surface 9A, with a conicity a preferably comprised between 1° and 4°, still more preferably 2°.

It has been noticed that the presence of the flange 14 housed in the groove 13 (when loaded by the tubular projection 9) together with the presence of the tooth 21 that cooperates with the pin 5A (or the pins) of the cursor 5 makes the cursor perfectly stable when in the lower end-stroke position (i.e. completely retracted stick).

This enables the machine disclosed here to easily overcome the so-called Amazon test, being able to suffer major shocks without the shocks causing the cursor 5 to move (and thus a contact between the tip of the stick and the closure 9).

To conclude the description of the present invention, it is noted that the first body can be torsionally integral with a handle 4 that cooperates removably (for example by snap connection, by magnets etc.) with the closure 6.

In order to make the machine more balanced and more easily usable, a counterweight 7 can be integrated in the handle (4).

Various embodiments of the innovation have been disclosed but others can be conceived exploiting the same innovative concept.

The invention claimed is:

1. Lip stick machine (1) comprising a first tubular body (2) on which a second tubular body (3) is rotatably fitted, the first tubular body (2) having at least one first guide (2A) and the second tubular body (3) having at least one second guide (3A), a cursor (5) equipped with at least one first pin (5A) housed both in said first (2A) and in said second guide (3A), so that a mutual rotation of the first tubular body (2) with respect to the second tubular body (3) causes an axial translation of the cursor (5), a closure (6) equipped with a tubular projection (9) configured to couple with a first free edge (11) of the first tubular body (2) when the closure (6) is fitted on the machine (1), characterized in that the second tubular body (3) has a first annular groove (13) open on a second free edge (12) of the second tubular body (3), the first tubular body (2) having a flange (14) at the first free edge (11), the flange (14) being positioned inside said first annular groove (13) so as to load a lateral surface (15) of the annular groove (13) when the closure (6) is fitted on the machine, a surface (16) of the first body (2) facing the tubular projection (9) having a second groove (18) in correspondence with said flange (14), the second groove (18) having a C-section, the closure having a reduced diameter surface (6A) configured to cooperate with a free end of the second tubular body (3) where the annular grove (13) is located, so that, when the closure (6) is in position, the flange (14) and the part of the tubular body (3) where the annular grove (13) is located are sandwiched between the tubular projection (9) and the reduced diameter surface (6A).

2. Machine according to claim 1, wherein said first guide (2A) is substantially rectilinear and in which said second guide (3A) is substantially helical or vice versa.

3. Machine according to claim 2, wherein the substantially rectilinear guide (2A) comprises an L-shaped end section (20), in which a tooth (21) is present which stabilizes said pin (5A) when in the end-stroke position.

4. Machine according to claim 1, wherein a contact zone (15) between the groove and said flange has a height (H1) comprised between 1.5 and 6 mm.

5. Machine according to claim 2, wherein the height is 2.25 mm.

6. Machine according to claim 1, wherein the tubular projection (9) has a conical perimeter surface (9A).

7. Machine according to claim 6, wherein the conical perimeter surface has a conicity between 1° and 4°.

8. Machine according to claim 6, wherein the conical perimeter surface has a conicity of 2°.

9. Machine according to claim 1, wherein the tubular projection (9) has a discontinuous surface.

10. Machine according to claim 1, wherein the first groove (13) has an L-section.

11. Machine according to claim 1, wherein the first body is torsionally coupled with a handle (4) which removably cooperates with the closure (6).

12. Machine according to claim 1, in which a counterweight (7) is integrated in the handle (4).

* * * * *